US006536613B2

(12) United States Patent
Shea

(10) Patent No.: US 6,536,613 B2
(45) Date of Patent: Mar. 25, 2003

(54) MERCHANDISING ASSEMBLY INCORPORATING A FLEXIBLE AND UNDULANT DISPLAY SURFACE

(76) Inventor: Thomas M. Shea, 1343 Rochester Rd., Troy, MI (US) 48083

( * ) Notice: Subject to any disclaimer, the term of this patent is extended or adjusted under 35 U.S.C. 154(b) by 0 days.

(21) Appl. No.: 09/864,746

(22) Filed: May 24, 2001

(65) Prior Publication Data

US 2002/0175132 A1 Nov. 28, 2002

(51) Int. Cl.[7] ..... A47F 5/08
(52) U.S. Cl. ..... 211/87.01
(58) Field of Search ..... 211/87.01, 103, 211/113, 118; 248/220.31, 220.41; D6/566

(56) References Cited

U.S. PATENT DOCUMENTS

| | | | | | |
|---|---|---|---|---|---|
| 5,096,070 | A | * | 3/1992 | Jaynes | 211/113 |
| 5,386,916 | A | * | 2/1995 | Valiulis | 211/113 |
| 5,660,286 | A | | 8/1997 | Shea | 211/87.01 |
| 5,743,403 | A | * | 4/1998 | Crysdale | 206/482 |
| 5,832,644 | A | * | 11/1998 | Mason | 248/900 |
| 5,957,422 | A | | 9/1999 | Shea | 248/220.31 |
| D422,483 | S | | 4/2000 | Shea | D8/354 |
| D422,886 | S | | 4/2000 | Shea | D8/354 |
| 6,070,747 | A | | 6/2000 | Shea | 211/87.01 |
| D432,844 | S | | 10/2000 | Shea | D6/566 |
| D435,381 | S | | 12/2000 | Shea | D6/566 |
| 6,202,866 | B1 | | 3/2001 | Shea | 211/87.01 |
| 6,363,643 | B1 | * | 4/2002 | Padiak et al. | 211/103 |

* cited by examiner

*Primary Examiner*—Alvin Chin-Shue
*Assistant Examiner*—Sarah Purol
(74) *Attorney, Agent, or Firm*—Gifford, Krass, Groh, Sprinkle, Anderson & Citkowski, P.C.

(57) ABSTRACT

A merchandising display supported upon a vertically extending surface. The display includes a substantially horizontally extending and rigid support having a first end and a second end, the first end engaging with the vertically extending surface. A substantially vertically extending display is attached to the second end of the rigid support and exhibits a substantially thin and flattened construction provides the display with flexibility both with respect to its own cross section and relative the rigid support. Pluralities of apertures are formed through the display and between first and second faces thereof. The pluralities of apertures further defining individual pairs of apertures extending lengthwise along the flexible display, the pairs of apertures are segregated into selected first and second closely spaced pairs. A plurality of merchandise support hangers are provided, each including a pair of tabs engaging through a selected pair of the apertures and so that respective pairs of the hangers extend in opposite and substantially proximate fashion from the first and second faces of the flexible display.

18 Claims, 9 Drawing Sheets

MERCHANDISING ASSEMBLY INCORPORATING A FLEXIBLE AND UNDULANT DISPLAY SURFACE

BACKGROUND OF THE INVENTION

1. Field of the Invention

The present invention relates generally to merchandising structures, attachable to existing gondola displays and other types of conventional and vertically extending shelving. More specifically, the present invention discloses a merchandising assembly incorporating a supporting yet undulant vertical display for carrying volumes of small and medium sized merchandise, and in particular high volume merchandise, upon either or both first and second faces of the display.

2. Description of the Prior Art

Merchandising display structures, such as those typically mounted upon vertically extending support surfaces, are well known in the art for supporting volumes of smaller and medium sized merchandise. Such display structures are particularly desirable to retail merchandisers in that they provide additional merchandise carrying capability, beyond that typically provided by the existing gondola shelving assemblies, and can further be employed at various desired locations throughout the store to provide product placement and point-of sale advertisements.

U.S. Pat. No. 5,660,286, issued to Shea, discloses one type of merchandising display structure mounted to a vertical support surface. The display structure further includes a single or pair of horizontally extending and rigid support members and to which is fixedly secured a further vertically and elongate extending display member. The display member is disclosed as being a rigid and substantially rectangular bar and through which are formed a plurality of apertures at spaced intervals, the apertures being designed to receive hooks or other conventional hangers for supporting large volumes of small sized packaged merchandise.

U.S. Pat. No. 6,202,866, also issued to Shea, discloses another type of merchandising display assembly which again includes a single horizontally extending support member. An elongated display member is provided in the form of a substantially flattened and rigid panel or grid which is secured to an outer end of the horizontal member in freely swinging and suspended fashion and extends in parallel fashion relative to the vertical support surface at a spaced distance. The display member exhibits a substantially flattened display area for securing thereon a plurality of hanger portions which are in turn capable of supporting volumes of small sized merchandise without obscuring additional merchandise which may be supported upon the vertical support surface.

A still further example of a rigid, vertically extending, swingable display is disclosed by U.S. Pat. No. 5,957,422, again issued to Shea, and which illustrates a substantially elongated and narrowed strip having first and second display faces and which are separated by a reinforcing and corrugated center. Apertures are again formed through the first and second display faces and through which are engaged merchandise support members (hooks) for supporting the volumes of merchandise.

SUMMARY OF THE PRESENT INVENTION

The present invention is a merchandise display assembly supported upon a vertically extending surface and which provides a substantially vertically extending and flexible display. The flexible and undulant nature of the display surface of the present invention is an improvement over the fixedly mounted or suspended rigid vertical display surfaces in the prior art in that the flexible display is constructed so that it can reliably support volumes of merchandise on either or both faces thereof, while at the same time embodying the flexible characteristics to provide both safety to individuals accidentally contacting the display and built-in visual attraction to the device. The combination of the flexible and undulant nature of the display, combined with the ability to configure the merchandising display also as a self-promoting advertisement with specific imprinted indicia, additionally provides the retailer/merchandiser with the opportunity to both increase the available merchandise carrying capacity within the retail establishment in addition to providing highly effective product placement and point-of-purchase advertisements.

The flexible display is shaped with a specified length, width and substantially thin thickness and is further constructed from a material such as a durable polystyrene or a laminated cover stock. The display may also include an exterior configuration created to match that of a certain type of product, quantities of which may be supported on the display and advertised for sale, as well as further advertisement and identifying indicia placed on the first and/or second faces of the flexible display and to provide additional point of purchase information.

Apertures are defined through the thin and flexible display, between its first and second faces. The apertures are preferably configured in individual pairs extending lengthwise along the display. The pairs of apertures are preferably segregated in closely spaced and first and second subset pairs. Support hangers each include a planar base, merchandise support hook and mounting tabs and so that individual pairs of the hangers may be mounted in opposite extending and proximate fashion to the flexible display. The arrangement and configuration of the support hangers is further such that each individual hanger, of a respective pair of proximately located and oppositely extending hangers, provides a counterweighing effect when loaded with quantities of merchandise.

The flexible display is again supported in spaced and vertically extending fashion from the existing and vertically extending surface by a substantially horizontally extending and rigid support. Each variation of the rigid support includes a first end engaging with the vertically extending surface and a second end to which is attached the flexible display. Variations of the rigid support include the provision of smaller off-shelf type brackets, fixed as well as axially adjustable elongate and planar shaped brackets, single or double brackets to which the flexible member is secured, and hooks from which the flexible display may be suspended from a single fixed or adjustable bracket.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
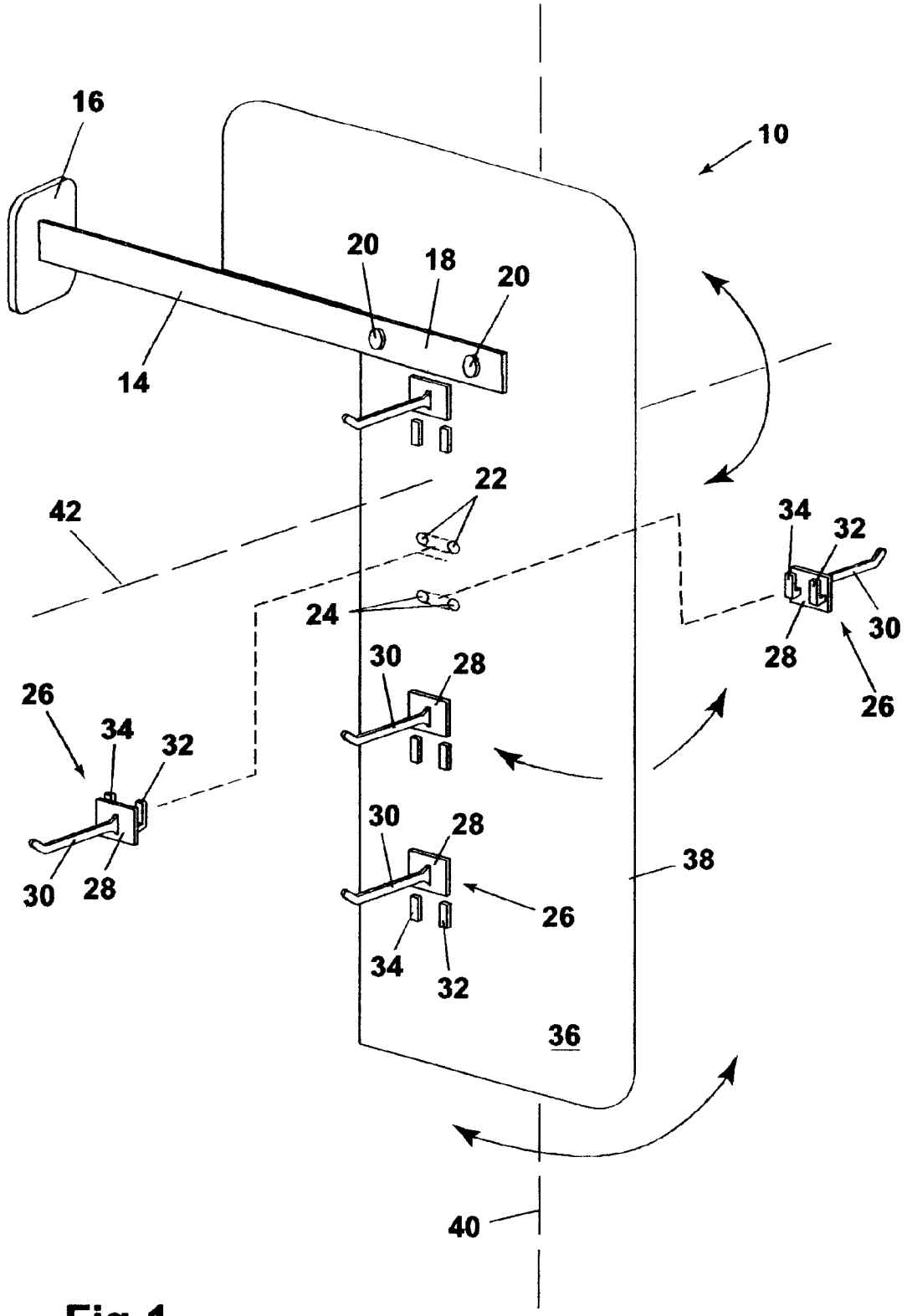
FIG. 1 is a perspective view of the merchandise assembly according to the present invention and which illustrates the flexible and undulant nature of the vertical display according to the present invention.

Referring now to FIG. 1, a merchandising assembly is illustrated at 10 and which incorporates a supporting yet flexible/undulant vertical display 12 for carrying volumes of small and medium sized merchandise, and in particular high volume merchandise, upon either or both first and second faces of the display. The present invention 10 is further an improvement over merchandising display assemblies illustrated in the prior art in that the display is constructed so that it can reliably support volumes of merchandise, while at the same time having flexible characteristics to provide both safety to individuals accidentally contacting the display and built-in visual attraction to the device. The combination of the flexible and undulant nature of the display, combined with the ability to configure the merchandising display also as a self-promoting advertisement with specific imprinted indicia, provides the retailer/merchandiser with the opportunity to both increase the available merchandise carrying capacity within the retail establishment in addition to providing highly effective product placement and point-of-purchase advertisements.

Referring again to FIG. 1, the first example 10 of the merchandising assembly includes a substantially and horizontally extending and rigid support 14 having a first end 16 including a foot support for engaging with a location of the vertically extending surface (not shown in this embodiment). The rigid support 14 is constructed as a substantially planar shaped and fixed bracket, the flexible display 12 securing to a second end 18 of the bracket, and such as through the provision of rivets 20, wing nuts or any other suitable type of fastener.

The flexible display is shaped with a specified length, width and substantially thin thickness and is further constructed from a material such as a durable plastic, such as polystyrene, a laminated cover stock and paper substrate. As will be further illustrated in the succeeding preferred embodiments, the display may also include an exterior configuration created to match that of a certain type of product, quantities of which may be supported on the display and advertised for sale, as well as further advertisement and identifying indicia placed on the first and/or second faces of the flexible display and to provide additional point of purchase information.

Figure 6:
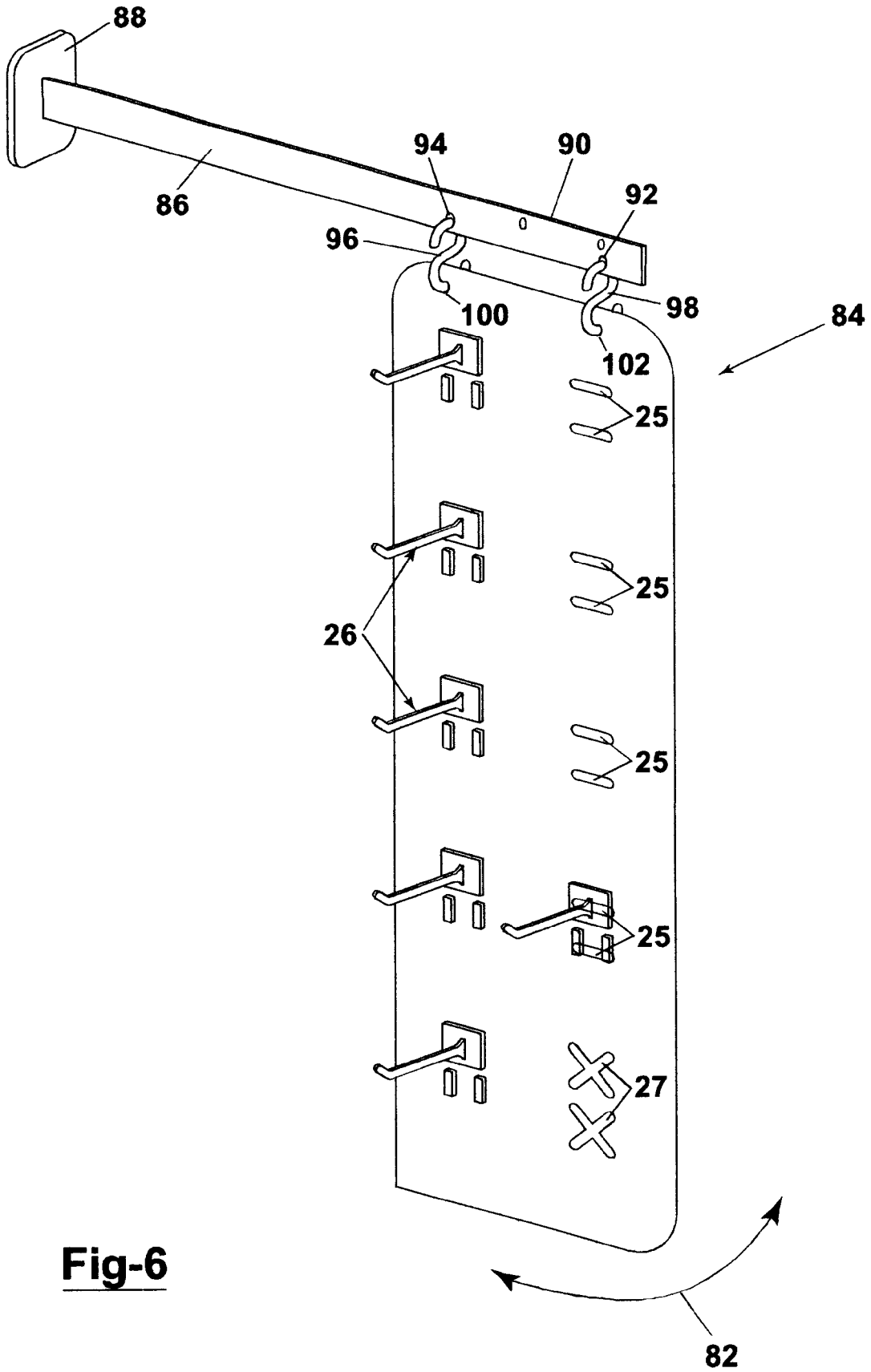
FIG. 6 is a still further perspective view of the merchandise display according to a fourth preferred embodiment of the present invention.

Apertures are defined through the thin and flexible display, between its first and second faces. The apertures are preferably configured in individual pairs extending lengthwise along the display. The pairs of apertures are preferably segregated in closely spaced and first and second subset pairs, such as at 22 and 24 in FIG. 1, and at a selected lengthwise extending location of the flexible display. In this fashion, and as is substantially illustrated in FIG. 1, three, four or more groups of first and second pairs of apertures may be arranged in the lengthwise spaced manner. Referring ahead to the alternate variant of FIG. 6, it is also envisioned that the apertures may be formed in any configuration desired including horizontally or vertically configured slots 25, slit "X" shaped apertures 27, or any other suitable shape, in addition to round shaped apertures, and which will support the merchandise hangers in the manner illustrated and described.

Referring again to FIG. 1, support hangers are illustrated in both mounted and exploded fashion in the perspective illustration. The hangers, in the variant illustrated, are all identical in construction and are therefore each identified at 26. The support hangers are constructed of a durable material, such as a heavy duty plastic, and referring to the pair of opposite extending hangers illustrated in exploded fashion in FIG. 1, each includes a planar base 28, a hook 30 extending from one side of the base 28, and first 32 and second 34 angularly configured tabs extending from the other side of the base 28.

The tabs 32 and 34 of each of the identically configured and exploded hangers 26, engage through respective pairs of the apertures, see at 22 and 24, and abut against respective first 36 and second 38 selected one of said display faces. The base 28 of each hanger 36 overlays an opposite one of each of the first 36 and second 38 faces and so that the associated hook 30 extends in opposite fashion and may support thereon a plurality of said merchandise.

The flexible nature of the display surface is capable of movement in response to accidental contact both along its own cross sectional axes (see at 40 and 42 in FIG. 1) as well as capable of flexing or moving relative to the rigid support 14. In consideration of this fact, it is desirable that the positioning of the hangers (with quantities of merchandise supported thereon) be such that neither side 36 or 38 is overloaded. Accordingly, the positioning of the hangers in closely spaced and oppositely extending pairs provides effective counterweighing along each side of the flexible display and, collectively, provides a substantially neat and overall appearance the merchandising display when fully loaded with quantities of merchandise and installed in location from the vertical support surface.

Figure 3:
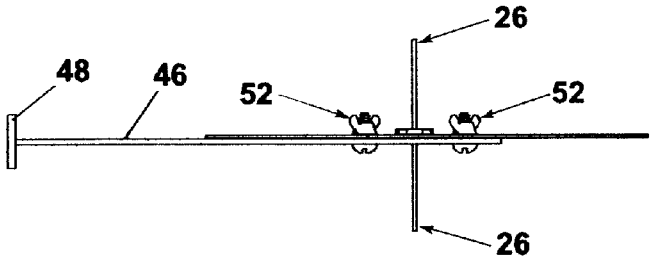
FIG. 3 is a top view of the merchandise assembly illustrated in FIG. 2.
Figure 2:
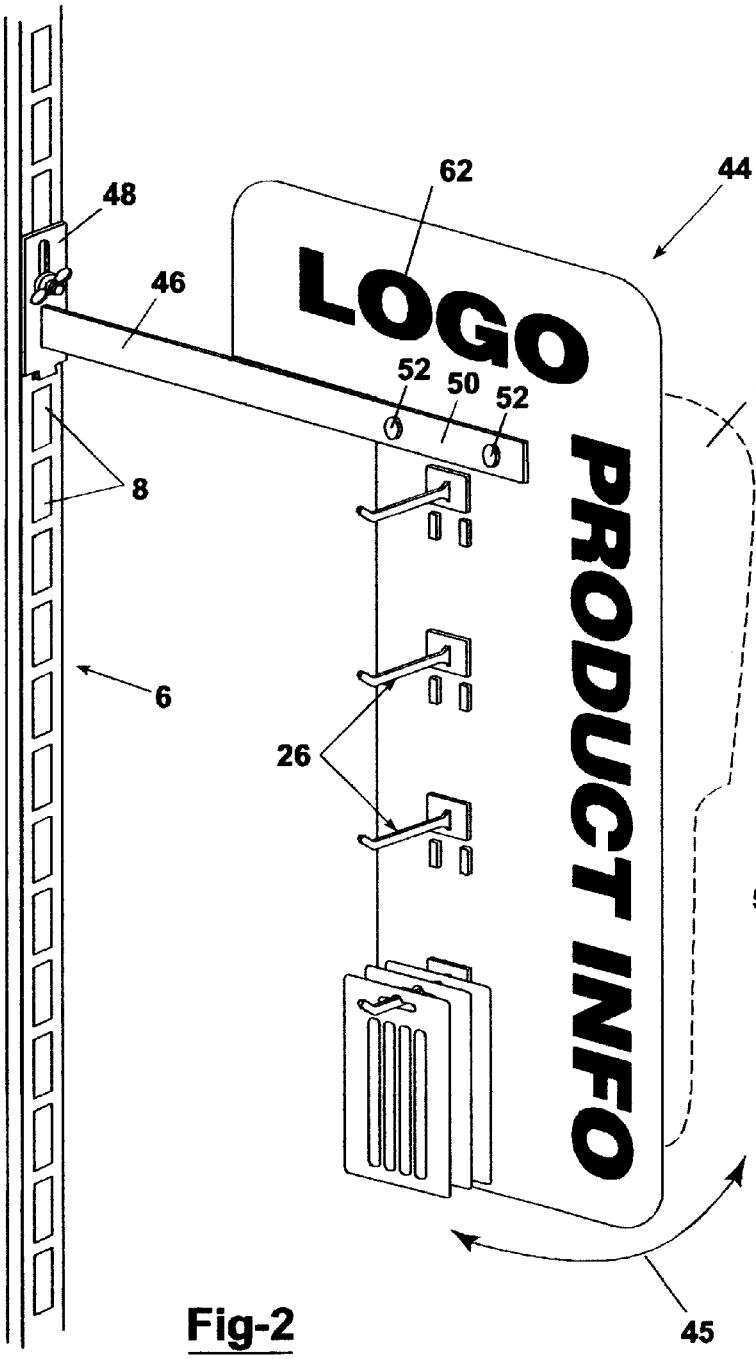
FIG. 2 is an additional perspective view of a second variant of the merchandise assembly, substantially similar to that presented in FIG. 1, and illustrating an environmental application in which the vertical display exhibits a given advertisement scheme.
Figure 4:
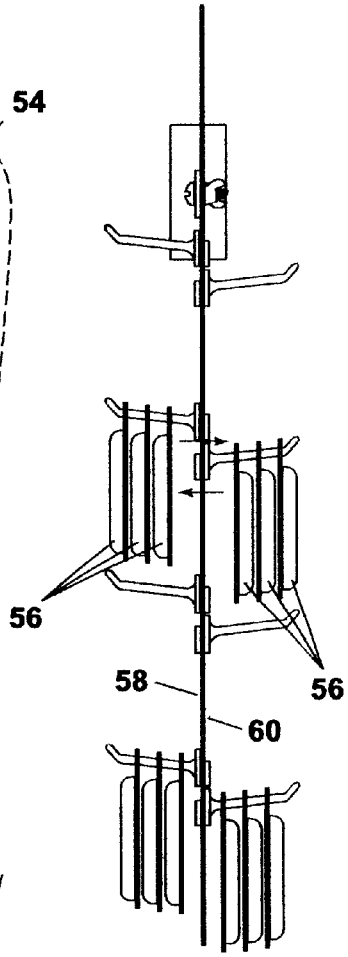
FIG. 4 is a front view of the merchandise assembly and further illustrating the flexible and undulant nature of the vertical display.

Referring to FIGS. 2–4, a merchandising display is illustrated at 44 according to a further preferred variant of the present invention and which closely approximates that previously illustrated at 10 in FIG. 1. A substantially and horizontally extending and rigid support 46 is again illustrated, similar in construction to that previously identified at 14, and having a first end 48 including a foot support, in this case a single-slotted backplate assembly, and engaging with a location of the vertically extending surface 6 as illustrated in the prior art. Apertures 8 are formed at spaced apart and vertically extending fashion along the vertical support surface 6, selected ones of the apertures receiving inserting portions (hidden from view but associated with the foot support 48 of the conventional single slot backplate and secured in place by a wing nut or other suitable fastener). The rigid support 46 is again constructed as a substantially planar shaped and fixed bracket, the flexible display 44 securing to a second end 50 of the bracket, and such as through the provision of rivets, wing nuts or any other suitable type of fastener and which are again illustrated at 52.

As has previously been described, the flexible display 44 again is shaped with a specified length, width and substantially thin thickness and is further constructed from a material such as a durable polystyrene or a laminated cover stock so that it is flexible about one or more axes (see also directional arrow 45 in FIG. 2). The flexible display 44 may also be reconfigured along its exterior configuration (see phantom designation 54 in FIG. 2) so as to match that of a certain type of merchandising product. Quantities of the desired merchandise 56 (and which may or may not match the exterior and identifying configuration 54 of the display) may be supported on both first 58 and second 60 faces of the display 44, as illustrated in the side view of FIG. 4. Additional and identifying indicia 62 may be placed on either or both the first and second faces 48 and 60 of the flexible display 44 and provide additional point of purchase information to the customer to entice purchase of the merchandise 56 supported thereon.

Figure 5:
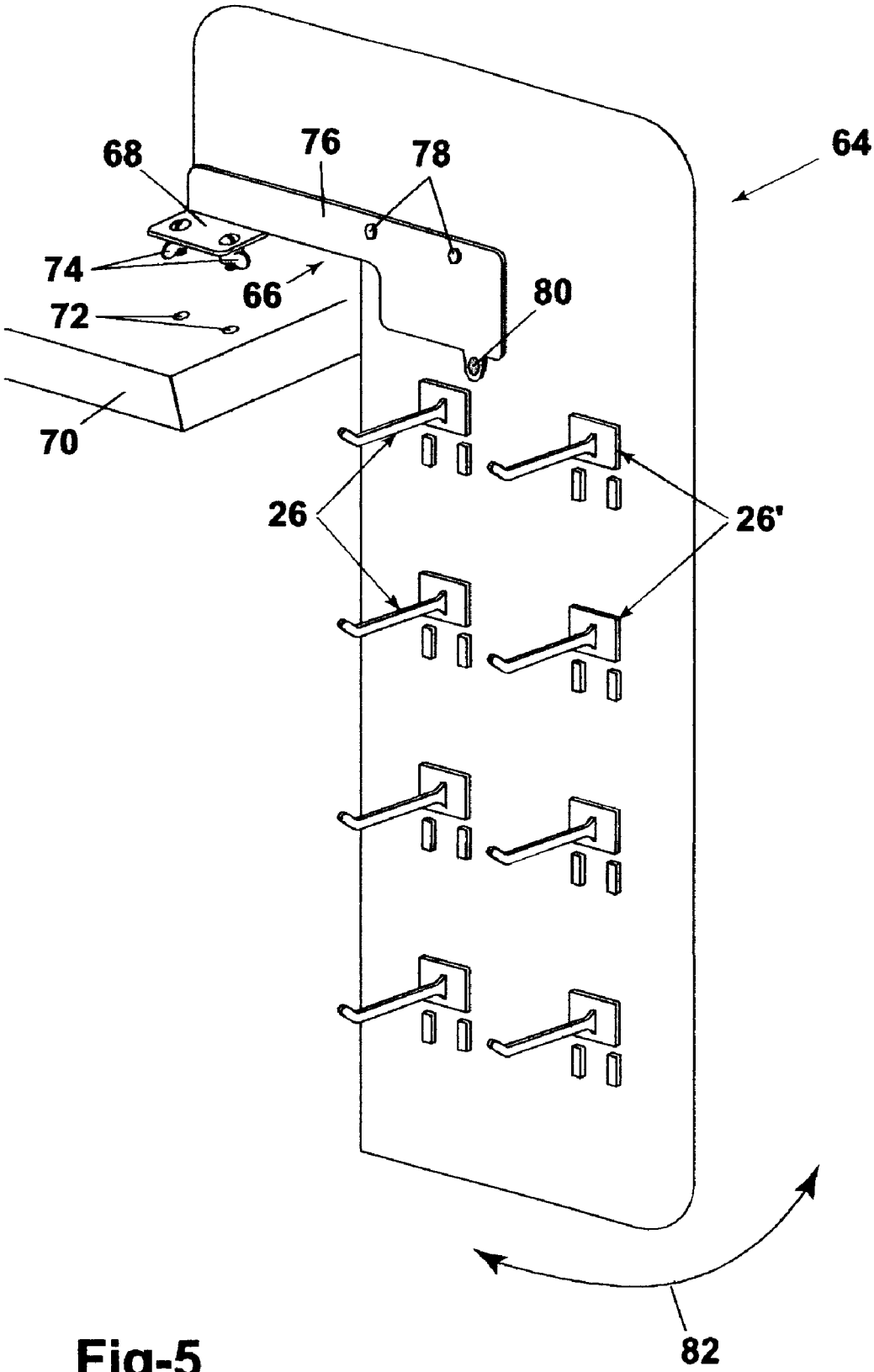
FIG. 5 is a perspective view of the merchandise display according to a third preferred embodiment of the present invention and illustrating an alternately configured variant of the support and vertical display.

Referring to FIG. 5, a further perspective view is illustrated at 64 of a flexible merchandising display according to a third preferred embodiment of the present invention. The display 64 is significantly identical to those previously illustrated in the embodiments of FIGS. 1–4, the only difference being the alternative variation of the rigid support in the form p of a substantially flattened off-shelf type bracket 66. A first end 68 of the bracket 66 defines a first planar portion extending parallel with a horizontal portion of the vertically extending surface (see fractional designation at 70 and with aperture 72 formed in vertically extending fashion therethrough). The bracket 66 is affixable by fasteners 74, a second end 76 of the bracket 66 defining a second planar portion extending in substantially perpendicular fashion relative to the first planar and horizontal portion 68. The flexible display 64 is secured, at an intermediate location defined by rivets or fasteners 78 and 80, in adhering fashion along the second planar portion 76 and so that the flexible display is movable thereto (see again by directional arrow 82) as well as flexible about its own cross section and as ha s been previously described. Also illustrated are a second row of hangers 26' which extend vertically and in parallel spaced apart fashion relative to the first row 26 of hangers. It is again contemplated that the underlying apertures can be formed in any desired shape for receiving the hangers.

Referring again to FIG. 6, a fourth variation 84 of the flexible display is illustrated, again as substantially and previously described, with the only difference being the provision of the rigid support in the shape of a fixed bracket 86 with a first end (foot support 88) engageable with the vertical support surface and a second end 90 with apertures 92 and 94 defined therethrough for receiving hooks 96 and 98. The hooks 96 and 98 (substantially "S" shaped in the preferred embodiment) likewise engage through additional apertures 100 and 102 formed proximate the upper end of the flexible display and suspend the flexible display 84. Again illustrated at 25 and 27 are the varied types of apertures in a second and vertically parallel extending row.

Figure 7:
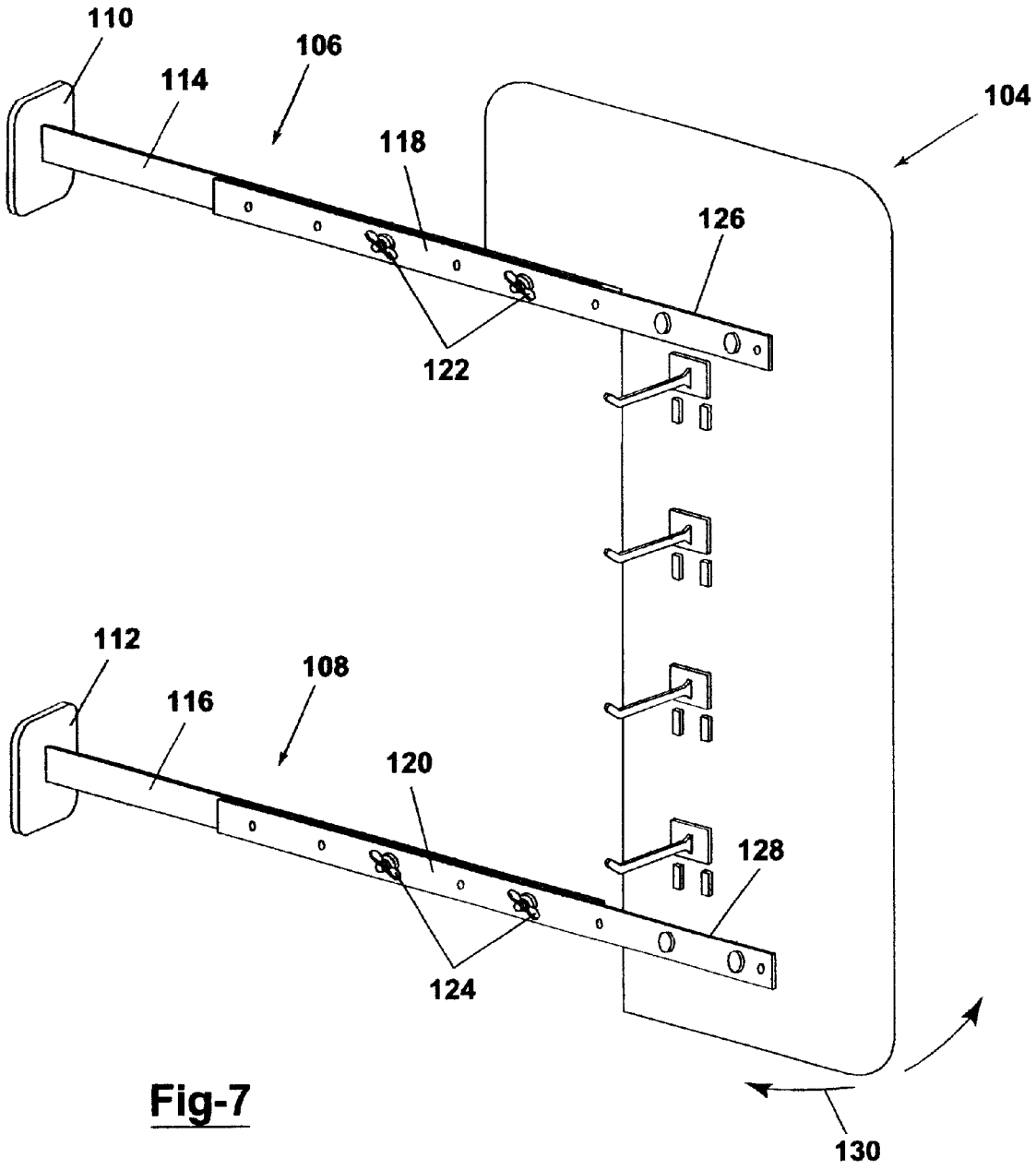
FIG. 7 is yet further perspective view of the merchandise display according to a fifth preferred variant and illustrating first and second spaced apart and horizontally extending and elongated supports.

Referring to FIG. 7, a fifth variation of the flexible display is illustrated at 104 and includes the provision of first 106 and second 108 elongate and rigid planar brackets. The brackets are substantially as previously described, each including foot support portions, 110 and 112 respectively, and each further including first 114 and 116 and second 118 and 120 overlapping and axially adjustable portions. The pairs 114 & 118 and 116 & 120 of adjustable portions each having respective and aligning pairs of apertures, selected ones of which receive wing nut fasteners 122 and 124 or the like to establish overall running lengths of the brackets. The flexible display 104 is fixedly secured to second extending ends 126 and 128 of the brackets 106 and 108, again such as through the use of rivets or other type fasteners. The nature of the fixed connection is still such that the flexible display is permitted a necessary degree of flexible movement (indicated by two-directional arrow 130) and, in the event of accidental contact by an individual, will provide a necessary degree of flexible give to prevent injury while at the same time accommodating the necessary merchandise support and advertisement requirements.

Figure 8:
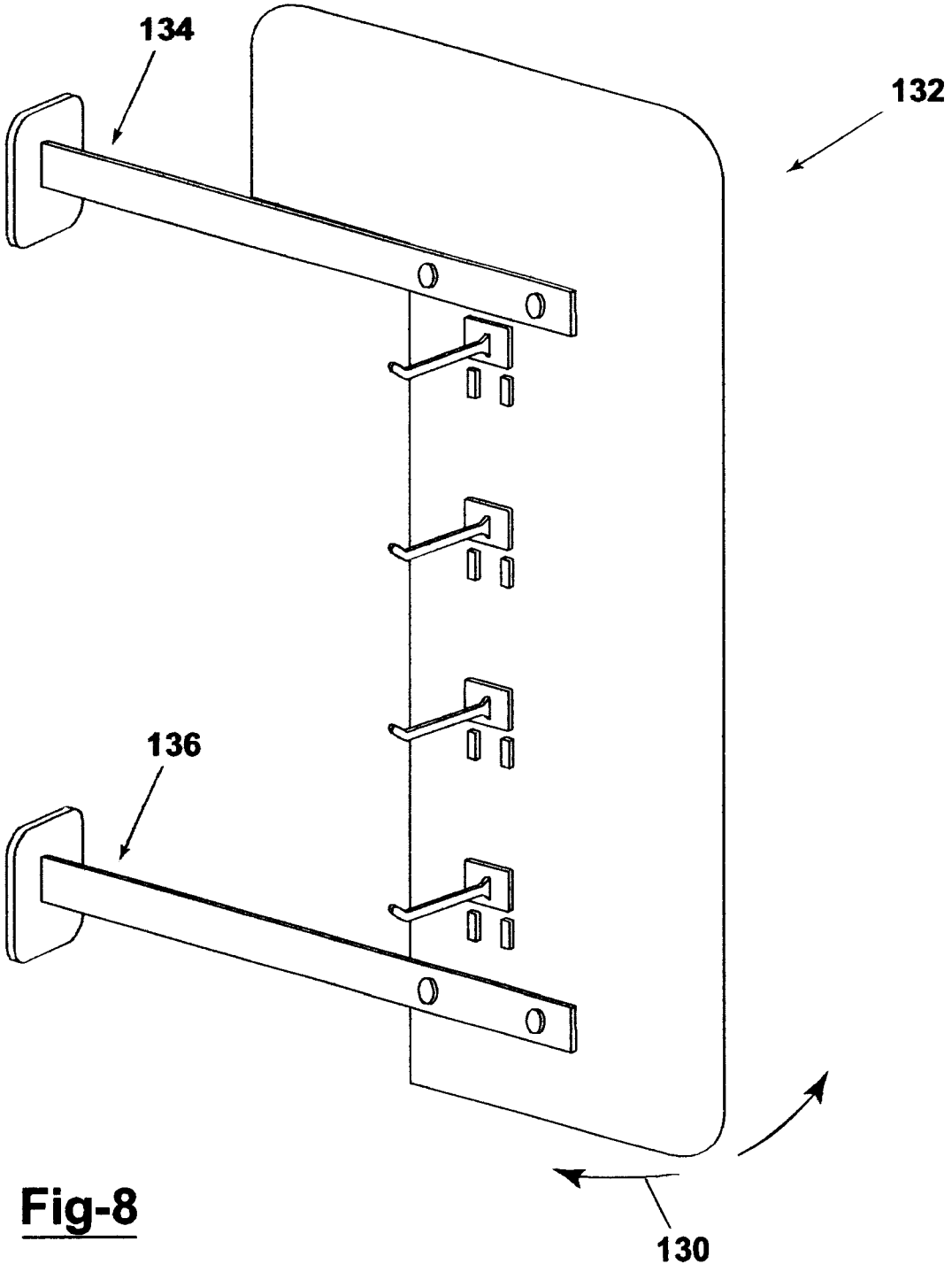
FIG. 8 is a perspective illustration of a sixth preferred variant and illustrating another variation with first and second fixed and elongated supports.
Figure 9:
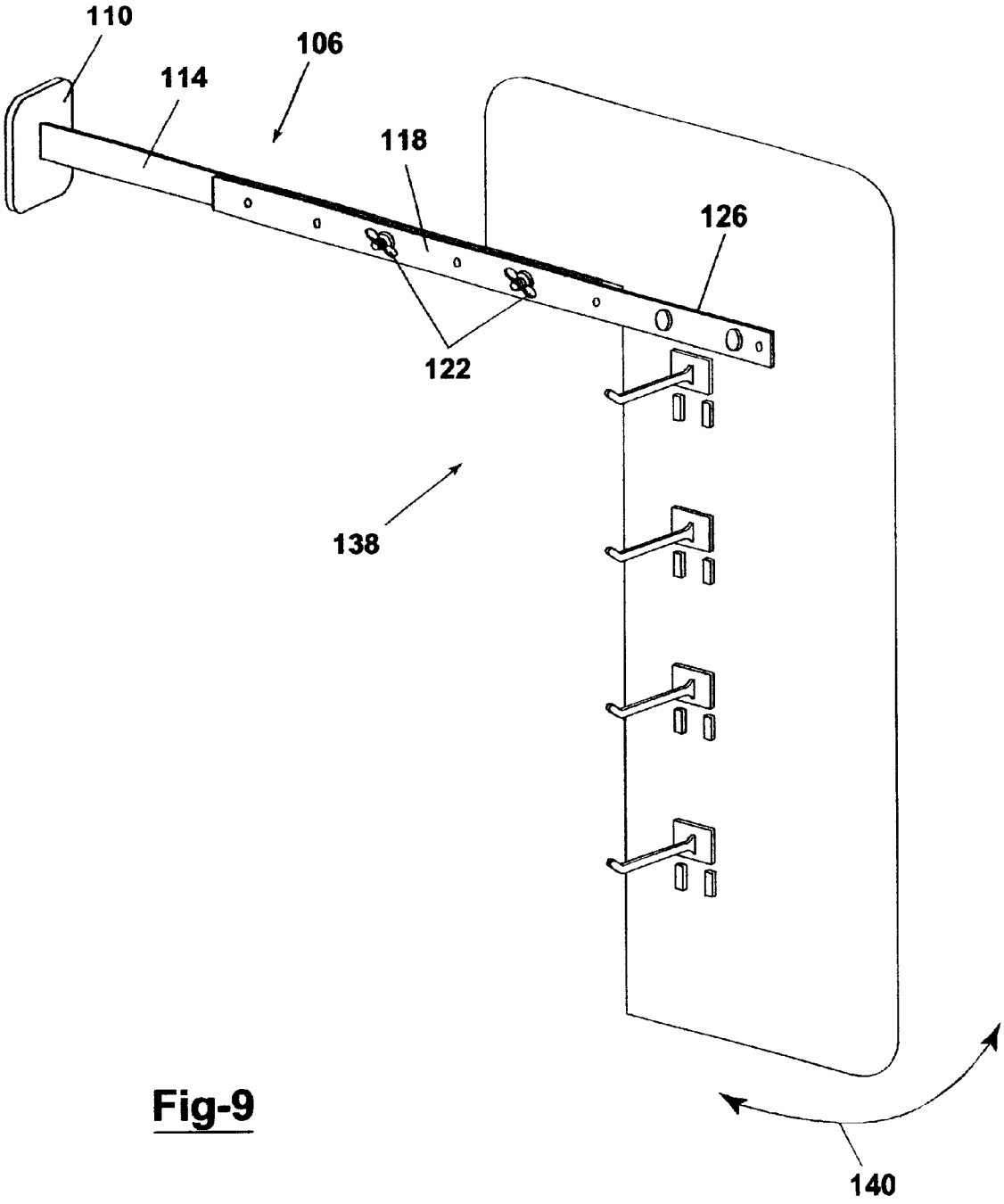
FIG. 9 is a perspective illustration of a still further and seventh variant of the present invention and illustrating the flexible and undulant vertical display supported by and extending from a single and axially adjustable elongate support.

Referring to FIG. 8, a sixth variation 132 of the flexible merchandising display is provided and is identical in numerous regards to that previously disclosed at 104 in FIG. 7, and with the exception that the support brackets 134 and 136 are fixed, as opposed to adjustable in an axial direction. Referring to FIG. 9, a seventh variant 138 of the flexible merchandising display is illustrated, largely similar to that previously illustrated in the initial variant of FIG. 1, and in which the fixed support bracket 14 is substituted by the single (and upper) axially adjustable bracket 106 also shown in FIG. 7. The flexible display 138 is therefore optionally secured at only an upper end thereof and is permitted a much wider degree of movement (again illustrated by arrow 140).

Figure 10:
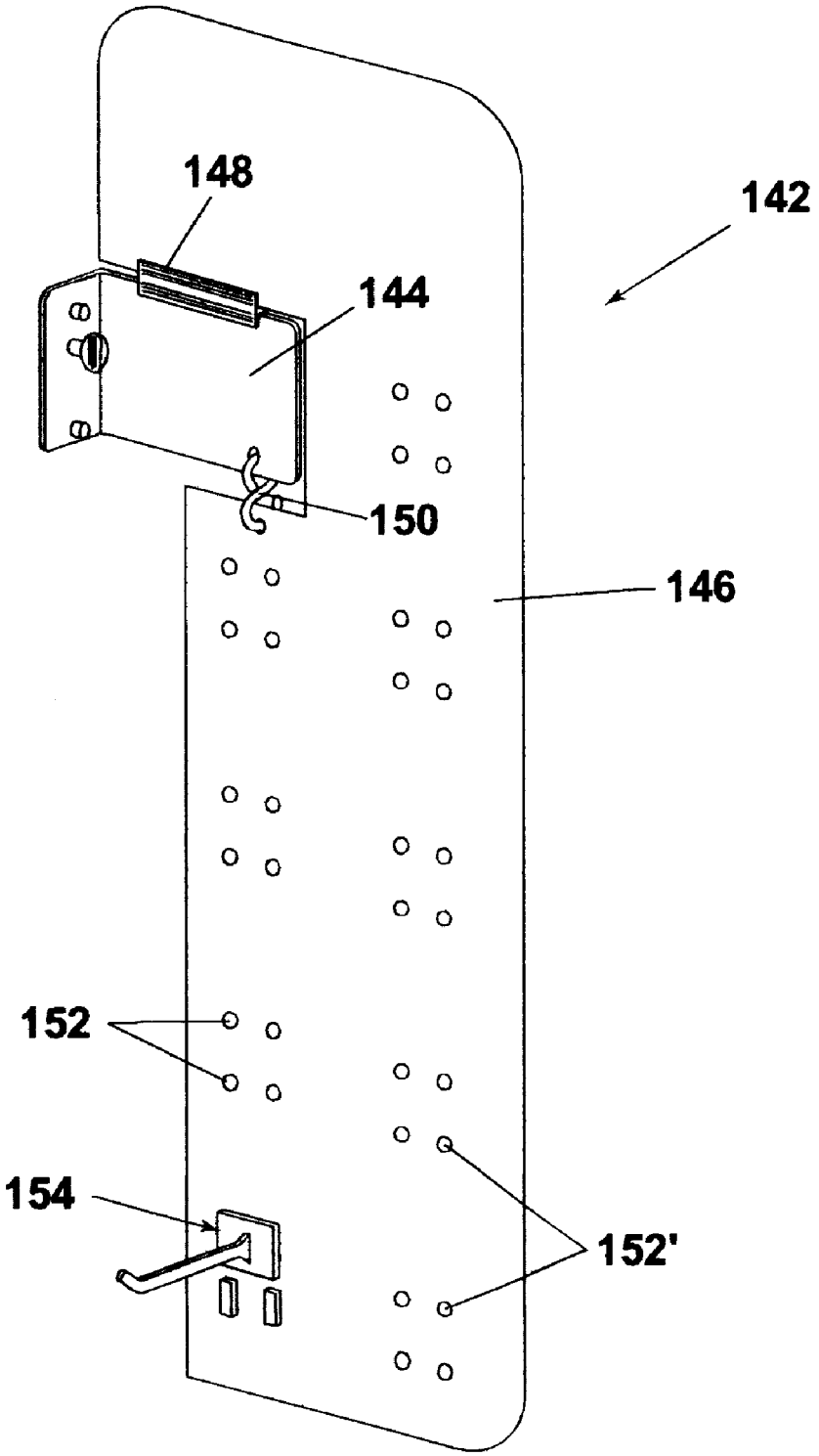
FIG. 10 is a perspective of an eighth variant of the present invention and illustrating the flexible display suspended from a pallet-type bracket.

Referring to FIG. 10, an eighth variant 142 of the flexible merchandising display includes provision of a pallet type bracket 144 to which flexible display member 146 is secured, such as by clips 148 and/or hooks 150. It is also contemplated that apertures 152 may be formed in singular and vertically extending fashion. An alternately configured hook member 154 may be employed, and which may suitably engage to a single one of the apertures 152. A second (or even third) row of apertures 152' may be provided to increase the merchandise carrying capacity of the display 142.

Figure 11:
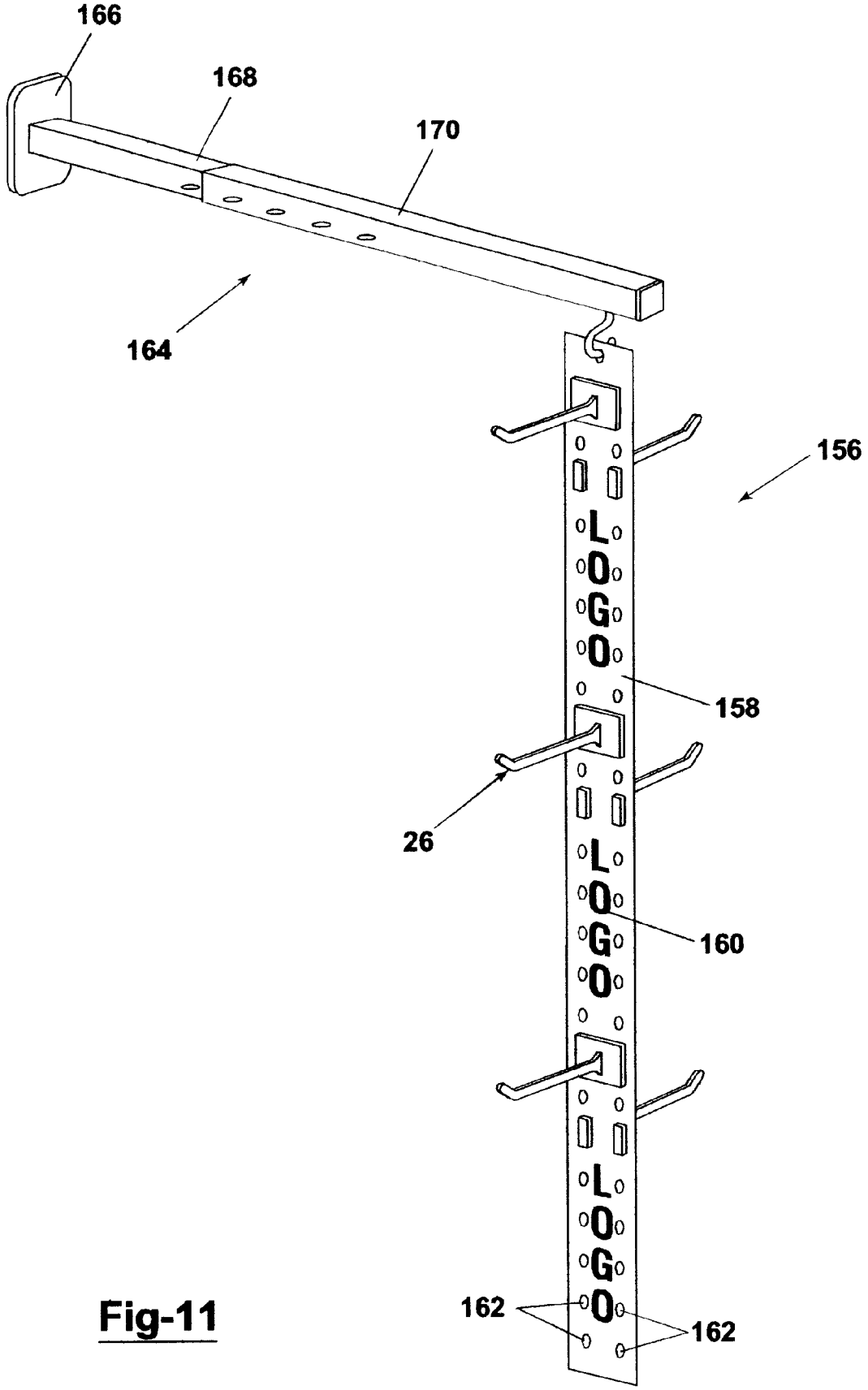
FIG. 11 is a perspective of a ninth variant of the present invention and illustrating an alternate configuration of the flexible display suspended from a bracket.

Finally, and referring to FIG. 11, a ninth variant 156 of the display is shown and which employs a substantially narrowed, yet still flexibly associated display 158. The display may again include a suitable and advertising logo indicia 160 printed or secured thereupon and apertures 162 may again be formed in suitable spaced and vertically extending fashion. It is also understood that length and width of the display 158 can be adapted to numerous different configurations, provided that the necessary characteristics of flexibility are maintained. A rigid support is provided as a tubular and axially adjustable support arm 164 having foot support 166 and first 168 and second 170 telescoping portions. It is further understood that the support can also be provided as a fixed tubular portion or flattened fixed or adjustable arms as previously illustrated.

Having described my invention, additional preferred embodiments will become apparent to those skilled in the art to which it pertains, and without deviating from the scope of the appended claims.

I claim:

1. A merchandising display supported upon a vertically extending surface, said display comprising:

a substantially horizontally extending and rigid support having a first end and a second end, said first end engaging with the vertically extending surface;

a substantially vertically extending display attached to said second end of said rigid support, said display exhibiting a substantially thin and flattened construction providing said display with flexibility, in response to any contacting force, both with respect to its own cross section and relative to said rigid support; and a plurality of apertures defined through said thin and flexible display and through which are engaged merchandise support hangers for suspending volumes of merchandise.

2. The merchandising display as described in claim 1, said vertically extending and flexible display having a specified length, width and thickness and further being constructed from a material selected from the group including a durable plastic, a laminated cover stock, and paper substrate.

3. The merchandising display as described in claim 1, said vertically extending and flexible display having a specified length, width and thickness and exhibiting a specified exterior configuration.

4. The merchandising display as described in claim 3, said display further comprising an advertisement and identifying indicia placed thereon.

5. The merchandising display as described in claim 1, said vertically extending and flexible display having a specified length, width and thickness, said apertures further comprising individual pairs of apertures.

6. The merchandising display as described in claim 5, said support hangers each further comprising a planar base, a hook extending from one side of said base, and first and second angularly configured tabs extending from the other side of said base, said tabs engaging through a respective pair of said apertures and abutting against a first selected one of said display faces, said base overlaying a second selected one of said faces and so that said extending hook supports thereon a plurality of said merchandise.

7. The merchandising display as described in claim 5, further comprising a plurality of individual pairs of apertures extending lengthwise along said flexible display, first and second selected pairs of said apertures being arranged in closely spaced and proximate fashion for receiving first and second support hangers in oppositely extending fashion.

8. The merchandising display as described in claim 1, said vertically extending and flexible display having a specified length, width and thickness, said apertures further comprising at least one row defining at least one vertically spaced and extending aperture.

9. The merchandising display as described in claim 1, said horizontally extending and rigid support further comprising an elongate and substantially planar shaped bracket, a foot support extending from said first end and engaging with at least one aperture formed in the vertically extending support surface.

10. The merchandising display as described in claim 1, further comprising said flexible display being suspended in swingable fashion by at least one hook from said second end of said rigid support.

11. The merchandising display as described in claim 9, further comprising first and second spaced apart and horizontally extending elongate brackets, said flexible display being secured, at corresponding upper and lower ends, to second associated ends of said brackets.

12. The merchandising display as described in claim 9, said planar shaped bracket further comprising first and second axially adjustable portions.

13. The merchandising display as described in claim 11, said first and second spaced apart and horizontally extending brackets each further comprising first and second axially adjustable portions.

14. The merchandising display as described in claim 1, said horizontally extending and rigid support further comprising a substantially flattened off-shelf type bracket, said first end defining a first planar portion extending parallel with a horizontal portion of the vertically extending surface and affixable thereto by at least one fastener, said second end defining a second planar portion extending in substantially perpendicular fashion relative to said first planar and horizontal portion, said flexible display being secured, at an intermediate location, along said second planar portion.

15. The merchandising display as described in claim 1, said horizontally extending and rigid support further comprising a pallet-type bracket, said first end defining a first planar portion extending parallel with a horizontal portion of the vertically extending surface and affixable thereto by at least one fastener, said second end defining a second planar portion extending in substantially perpendicular fashion relative to said first planar and horizontal portion, said flexible display being secured, at an intermediate location, along said second planar portion.

16. The merchandising display as described in claim 1, said horizontally extending and rigid support further comprising a tubular bracket having a foot portion, a first connected support portion and a second telescoping and axially adjustable support portion.

17. The merchandising display as described in claim 1, said vertically extending and flexible display having a specified length, width and thickness, said apertures further comprising at least one selected from the group including round apertures, elongated slot-shaped apertures and "X" slit shaped apertures.

18. A merchandising display supported upon a vertically extending surface, said display comprising:

a substantially horizontally extending and rigid support having a first end and a second end, said first end engaging with the vertically extending surface;

a substantially vertically extending display, attached to said second end of said rigid support, and exhibiting a substantially thin and flattened construction providing said display with flexibility, in response to any contacting force, both with respect to its own cross section and relative said rigid support;

pluralities of apertures being formed through said display and between first and second faces thereof, said pluralities of apertures further comprising individual pairs of apertures extending lengthwise along said flexible display; and a plurality of merchandise support hangers, each of said support hangers including at least one tab engaging through at least one of said apertures and so that respective pairs of said hangers extend in opposite and substantially proximate fashion from said first and second faces of said flexible display.

* * * * *